United States Patent [19]

Morse

[11] Patent Number: 4,700,108

[45] Date of Patent: Oct. 13, 1987

[54] CAVITY SYSTEM FOR A PARTICLE BEAM ACCELERATOR

[75] Inventor: Alfred W. Morse, Ellicott City, Md.

[73] Assignee: Westinghouse Electric Corp., Pittsburgh, Pa.

[21] Appl. No.: 783,394

[22] Filed: Oct. 2, 1985

[51] Int. Cl.[4] ..... H01J 25/10

[52] U.S. Cl. ..... 315/5.41; 328/233; 330/53; 330/56

[58] Field of Search ..... 328/233; 315/5.41; 330/53, 56

[56] References Cited

U.S. PATENT DOCUMENTS

| | | | |
|---|---|---|---|
| 2,883,536 | 4/1959 | Salisbury et al. | 315/5.41 |
| 3,333,142 | 7/1967 | Takeda et al. | 328/233 |
| 4,064,464 | 12/1977 | Morse | 330/53 |
| 4,329,654 | 5/1982 | Chamberlain | 328/233 |
| 4,392,079 | 7/1983 | Pasmannik | 315/5.44 |
| 4,596,946 | 6/1986 | Pottier | 328/233 |

*Primary Examiner*—Harold Dixon
*Attorney, Agent, or Firm*—W. G. Sutcliff

[57] ABSTRACT

Apparatus and method for generating and controlling the electric field within the cavity of a particle beam accelerator. A power splitter divides a common drive signal into separate branches each driving separate RF amplifiers. The output of each amplifier is coupled, through a circulator, to a separate input launcher within the cavity. The high Q of the cavity causes the signal from each launcher to combine to form an undistorted field pattern within the cavity regardless of small amplitude and phase differences at each launcher. Total power control is maintained by changing the phase in one or more of the separate branches, or by chopping the power applied to the amplifiers in the controlled branches. To improve efficiency, the input launchers in branches which are turned off by the chopping technique may be shorted to ground during the turned off interval.

18 Claims, 3 Drawing Figures

CAVITY SYSTEM FOR A PARTICLE BEAM ACCELERATOR

BACKGROUND OF THE INVENTION

This invention relates, in general, to particle beam accelerators and, more specifically, to RF amplifier configurations for creating electric fields within a resonant cavity.

Particle beam accelerators require large amounts of RF energy to produce the accelerating fields in cavity structures, such as drift tube linacs and radio frequency quadrapoles. The RF requirements range from a few kilowatts up to several megawatts, at all duty cycles up to continuous wave (CW). The majority of the prior art particle beam accelerators have used klystron amplifiers to provide the high power RF energy to the resonant cavity, but solid state amplifiers are becoming more popular and offer the greatest promise for increased reliability, efficiency, and ease of operation.

Various solid state amplifier arrangements have been proposed for use in particle beam accelerators. For example, U.S. Pat. No. 4,064,464, issued Dec. 20, 1977 to the same inventor and assignee as the present invention, discloses a solid state amplifier which may be used to provide the high power necessary to drive the cavity in a particle beam accelerator. The referenced patent includes a phase control system which regulates the amount of power provided at the output of the amplifier system. Such system is advantageous over prior art systems in various applications. However, the power combiner required in such system adds to its complexity and detracts somewhat from its efficiency. Therefore, it is desirable, and it is an object of this invention, to provide a unique and novel arrangement for combining the output signals from the various separate RF amplifiers comprising the amplification system.

Proper and efficient operation of a particle beam accelerator requires that the resonant cavity of the accelerator be driven by a power amplification system which has the ability to have its output power dynamically controlled to compensate for beam dynamics, cavity temperature drifts, and RF droop. In typical klystron systems, this is accomplished by changing the RF drive level of the klystron and by the partial linear gain characteristics of the klystron tube. For either solid state or klystron amplifiers, a control range of about 10% is desirable.

In solid state amplifier systems for driving cavity resonators, control of the amplitude or power output of the amplification system cannot be conveniently accomplished by low level drive signal changes since the amplifiers typically operate under class C conditions. In order to alleviate this problem, the system shown in U.S. Pat. No. 4,064,464 may be used wherein the phase relationship between some of the amplifiers is changed for the purpose of changing the overall power output of the system.

Proper coupling of the outputs from separate amplifier systems requires the use of suitable isolators, directional couplers, or circulators. Since phase control does not change the amount of power supplied by a particular amplifier circuit or system, a change in coupling relative to the other amplifiers necessitates a loss or waste of power in the circulators, directional couplers, or isolators which are used to couple the systems together. Therefore, it is desirable, and it is another object of this invention, to provide a system for controlling or changing the power of an amplifier system driving a resonant cavity which does not waste or dissipate unneeded power in components used to combine the power from the separate amplifiers. The need for this advantage is particularly important in systems which are operating with extremely high power requirements.

SUMMARY OF THE INVENTION

There is disclosed herein a new and useful system for connecting solid state RF amplifiers to the resonant cavity of a particle beam accelerator system. The system disclosed herein provides for the elimination of any separate power combiners for combining the outputs of the separate RF amplifiers since the combining is done within the resonant cavity. Another feature of the invention provides greater efficiency by utilizing a control technique which does not cause significant power losses attributable to the power control portion of the system.

The power system includes a number of separate RF power amplifiers each connected through a separate isolator, or circulator, to a separate input launcher located within a resonant cavity. Each of the separate RF amplifiers is driven by a common drive signal which has been split into separate branches for driving each separate amplifier. Due to the high Q of the resonant cavity, the total magnitude of electric field required for particle beam accelerator applications is suitably generated by the combining of the outputs of the power amplifiers within the cavity. A sensing or sampling probe is also contained within the cavity and supplies a control signal to an amplitude and phase detector. The amplitude detector controls the power control circuit which is associated with a limited number of the separate power amplifiers. The phase detector controls the phase of the entire amplification system for permitting the application of power to the resonant cavity with the proper phase relationship.

According to one specific embodiment, the power control portion of the amplifier circuit changes the phase of one or more separate RF amplifiers. The output of each controlled amplifier is combined, within the resonant cavity, with the outputs of the other RF amplifiers. According to another specific embodiment, an RF switch is used to control the power to the controlled RF amplifiers. The RF switch is activated by a pulse width modulator which is responsive to the signal from the sampling probe in the cavity. Since the RF switch turns the power off from the controlled power amplifiers, power is not wasted or dissipated in the circulators associated with the amplifiers. In addition, another RF switch may be located between the circulator and the input launcher in the cavity. This switch further isolates the amplifier and circulator circuitry from the field in the resonant cavity and prevents power dissipation in the circulator caused by signals originating from the input launcher as a result of fields produced by the other power amplifier circuits.

DESCRIPTION OF THE DRAWINGS

Further advantages and uses of this invention will become more apparent when considered in view of the following detailed description and drawings, in which.

DESCRIPTION OF THE PREFERRED EMBODIMENTS

Figure 1:
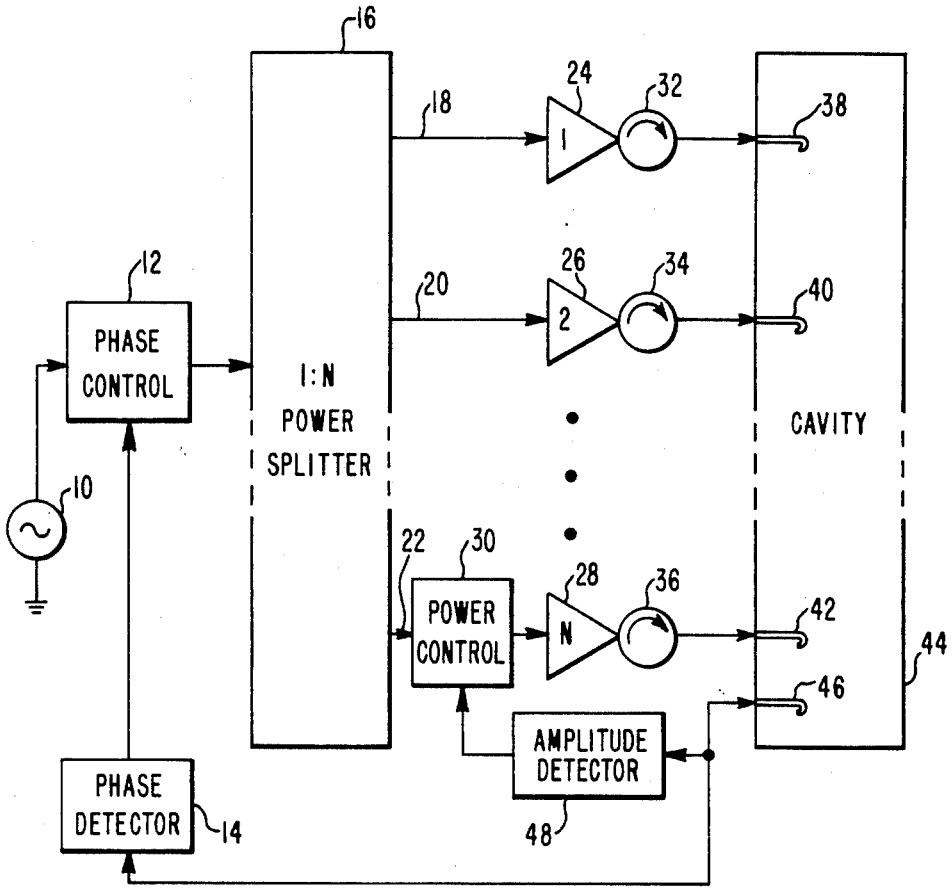
FIG. 1 is a block diagram illustrating a specific embodiment of the amplifier-cavity system.

Throughout the following description, similar reference characters refer to similar elements or members in all of the figures of the drawings.

Referring now to the drawings, and to FIG. 1 in particular, there is shown a block diagram of a cavity amplifier system constructed according to a specific embodiment of this invention. According to FIG. 1, the RF signal is originally generated by the generator 10 and applied to the phase control 12. After having the phase adjusted properly, as controlled by the phase detector 14, the signal is applied to the power splitter 16. The power splitter 16 divides the applied power into N separate power signal branches, such as branches 18, 20 and 22. Each signal branch eventually supplies input power to separate RF power amplifiers, such as power amplifiers 24, 26 and 28.

Although only three power amplifiers are shown in FIG. 1, various other numbers of amplifiers and/or power splitting arrangements can be used within the contemplation of this invention. The only necessary requirement is that the separate power signal branches drive separate power amplifiers, with some of the separate power amplifiers being power controlled by a suitable device, such as the power control 30 shown in FIG. 1. In a typical system, for example, there may be one hundred separate RF solid state power amplifiers, with ten of the separate amplifiers having power control capabilities. In another arrangement, a 1:2 power splitter may be used ahead of two separate 1:N power splitters, with the power control effective on one of the two power circuit branches, thereby providing a system wherein N number of amplifiers are provided for supplying fixed power and N number of separate amplifiers are available for supplying controlled power.

Referring again to FIG. 1, the separate RF amplifiers 24, 26 and 28 are connected through isolators 32, 34 and 36 to input launchers, or probes, 38, 40 and 42 which are located within the cavity 44. The circulators 32, 34 and 36 prevent power induced into the probes, or input launchers, 38, 40 and 42 from traveling back into the separate RF amplifiers.

The cavity 44 is a resonant cavity structure, such as a drift tube linac or a radio frequency quadrapole. The purpose of the cavity is to provide a region in which a strong electric field is present due to the power supplied to the input launchers from the separate RF amplifiers. Ordinarily, injecting the separate branch signals into the cavity 44 by separate input launchers would have a random relationship upon the combining of the power signals from each branch. However, since the cavity 44 is selected to have an extremely high Q, on the order of several thousand, and in all cases greater than one thousand, and since the input launchers 38, 40 and 42 are suitably positioned within the cavity 44 to provide identical coupling to each separate branch, the electric field provided by the combination is equivalent to that produced by the combined power of the separate branches. Test results of apparatus constructed according to this invention has shown that, when high Q cavities are used, the power signals are suitably combined within the cavity structure even though injected into the cavity by separate input launchers.

Probe 46 is also located within the cavity 44 and provides a means for acquiring a sample, or signal, corresponding to the electromagnetic field contained within the cavity 44. In this description, electromagnetic field includes either the electric field or the magnetic field. Due to the interrelation between these two fields, the probe 46 may sample either the electric or the magnetic field. The signal from probe 46 is applied to the amplitude detector 48 and to the phase detector 14. The amplitude detector 48 suitably conditions the sampled signal, as is well known in the prior art, and sends the appropriate signal to the power controller 30 for controlling the power of the separate RF amplifier 28. In the three-amplifier arrangement shown for convenience and clarity in FIG. 1, the controlling of the separate amplifier 28 is sufficient to adjust or maintain the overall power provided by all three amplifiers within the tolerance desired.

Figure 2:
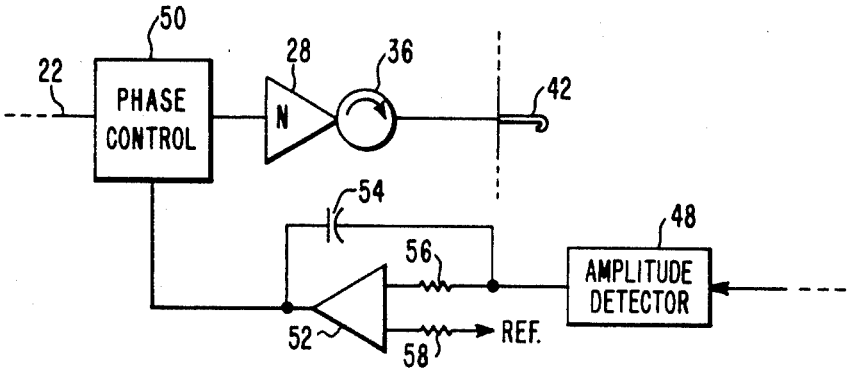
FIG. 2 is a hybrid block-schematic diagram illustrating one arrangement for controlling the power of the amplifying system.

FIG. 2 is a diagram illustrating one arrangement for controlling the power of the separate amplifier or amplifiers which have their power regulated or controlled in order to maintain the total power in the cavity within the desired limits. According to FIG. 2, the power control circuit includes the phase control 50 which can control the phase of the signal arriving at branch 22 and entering the separate RF amplifier 28. The operational amplifier 52, the capacitors 54, and the resistors 56 and 58 form a part of the reference circuit which changes the signal from the amplitude detector 48 into the form necessary for driving the phase control 50. Changing of the output power by changing the phase of the power output, that is, by controlled phase interference, is one technique for maintaining the total power in the cavity within the desired tolerances.

Figure 3:
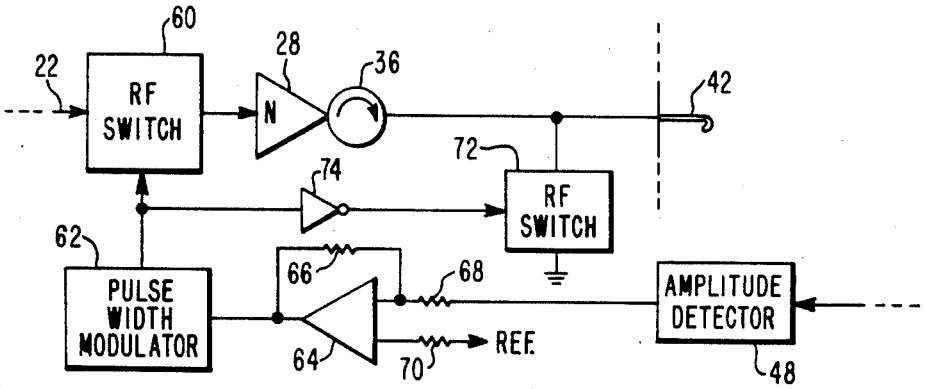
FIG. 3 is a hybrid block-schematic diagram illustrating another arrangement for controlling the power of the amplifying system.

Another technique for maintaining the total power level within the cavity is shown by the circuit of FIG. 3. As illustrated in FIG. 3, an RF switch 60 is located in the power signal branch 22 ahead of the RF power amplifier 28. The RF switch functions to either turn-on or turn-off the drive power to the amplifier 28. When the RF switch 60 is conducting, or turned on, the RF amplifier 28 provides its full output power through the circulator 36 to the input launcher 42. When the RF switch 60 is turned off, the drive to the RF amplifier 28 is interrupted and no power output is applied to the input launcher 42. Depending upon the type of amplifier used, the RF switch may, in addition to switching the input power to the amplifier, be required to limit the power dissipation in the RF amplifier 28 during periods when no drive is present.

Control of the RF switch 60 is provided by the pulse width modulator 62 which is driven by the signal from the amplitude detector 48 after being altered, or conditioned, by the operational amplifier 64 and the resistors 66, 68 and 70. The amount of average power delivered by the RF amplifier 28 is dependent upon the length of time the switch 60 is conducting. Thus, modulating or changing the width of the on pulse to the switch 60 by the pulse width modulator 62 controls the average power output of the amplifier 28. Any ripple in the cavity field can be reduced to an arbitrarily small level by increasing the frequency of the chopping action. Instead of using a pulse width modulator 62, a pulse rate modulator may be used without departing from the teachings of the invention. Also, if the amplifier 64 is connected to operate as a comparator, its output could bypass the modulator 62 and control the switch 60 directly.

Even though no power is delivered from the amplifier 28 when it is turned off, a certain amount of losses occur in the circulator 36 under these conditions. This power is derived from the induced signal from input monitor, or probe, 42 as a result of the electric field within the cavity provided by the other RF power amplifiers. This provides a power signal which, if not for the RF switch 72, would travel back to and be dissipated in the circulator 36. However, according to this invention, a further improvement in efficiency can be achieved by using the RF switch 72 as shown in FIG. 3. The RF switch is controlled by the same pulse width modulator 62 which controls the RF switch 60. However, when the switch 60 is on, the switch 72 is turned off, as indicated by the inverter stage 74. Having the RF switch 72 turned off allows the normal supplying of power from the RF amplifier to the input launcher 42. However, when the power amplifier 28 is turned off, the input launcher 42 is shorted to ground by turning on the RF switch 72. This prevents power from being taken from the cavity by the input launcher 42 and dissipated in the circulator 36. Even without the arrangement provided by switch 72, the pulse modulated embodiment of this invention is more efficient than prior art phase modulation systems.

The RF switch 60 operates as a high speed chopper in the megahertz range, and produces variable duty cycle inputs to the amplifiers or modules under its control. The effective inertia of the stored energy in the cavity will integrate the chopping action and produce a smoothly controlled RF field within the cavity. The ripple on the cavity field can be reduced to an arbitrarily small level by increasing the frequency of the chopping action.

The techniques disclosed herein make use of the significant stored energy in a high Q resonant cavity, and permit amplitude control of the cavity RF field with greatly reduced system losses. Because of the high Q of the cavity necessary for the proper operation of this invention, the internal field pattern is not distorted by phase or amplitude differences among the individual amplifier modules. Thus, the cavity field can be sampled at a single point from a single probe and this sample can be used to control the phase and amplitude of the aggregate amplifiers in a simple fashion. In the phase control embodiment of the invention, the high Q of the cavity will force the internal fields to respond to the average phase of the RF amplifiers, and the phase mismatch will manifest itself to the amplifiers as a mismatch at the multiple cavity inputs.

Since different embodiments of the invention may be made without departing from the scope of the invention, it is intended that all of the matter contained in the foregoing description, or shown in the accompanying drawing, shall be interpreted as illustrative rather than limiting.

I claim as my invention:

1. A cavity system having a controlled electric field for use in particle beam accelerators, said system comprising:

a resonant cavity having a plurality of input launchers suitably positioned within the cavity so that they are identically coupled to the combined electric field in the cavity;

means for splitting an RF signal into a plurality of signal branches;

means for amplifying the signal in each branch;

means for applying the amplified signal in each branch to separate input launchers in the cavity which applying means includes an isolator effectively located between the amplifying means in each signal branch and the input launcher to which the amplified signal is applied;

a single means for sampling the electromagnetic field in the resonant cavity and providing a signal responsive to the sampled field; and means responsive to said sampled signal for changing the amount of power, in at least one of said branches, which contributes to the electric field contained within the resonant cavity.

2. The cavity system of claim 1 wherein the sampling means uses just one sampling probe located within the cavity.

3. The cavity system of claim 1 wherein the Q of the cavity is greater than 1,000.

4. The cavity system of claim 1 wherein the power changing means includes means for chaning the phase of the signal in the branches which have their power changed.

5. The cavity system of claim 4 wherein the phase changing means changes the phase of the signal which drives the amplifying means in said branches.

6. The cavity system of claim 1 wherein the power changing means includes means for pulse modulating the signal in the branches which have their power changed.

7. The cavity system of claim 6 wherein the pulse width modulating means includes RF switching means which switches on and off the signal which drives the amplifying means in said branches.

8. The cavity system of claim 6 including switching means for shorting the input launchers to ground in branches which have their power changed when said amplifying means is switched off by the pulse width modulating means.

9. A cavity system having a controlled electric field for use in particle beam accelerators, said system comprising:

a resonant cavity having a Q of greater than 1,000;

means for splitting an RF signal into a plurality of signal branches;

RF amplifiers connected for amplifying the signals in each signal branch;

circulators connected to the output of each RF amplifier;

a plurality of input launchers located within said cavity, with a separate launcher connected to each of said circulators, said launchers being suitably positioned within the cavity so that they are all identically coupled to the combined electric field in the cavity;

a single sampling probe located within said cavity; and means responsive to a signal from said sampling probe for controlling the amount of power, in at least one of said branches, which contributes to the electric field contained within the cavity.

10. The cavity system of claim 9 wherein the power controlling means includes means for changing the phase of the signal to the amplifiers in branches which have their power changed.

11. The cavity system of claim 9 wherein the power controlling means includes means for switching on and off the signal to the amplifiers in branches which have their power changed.

12. The cavity system of claim 11 wherein the power controlling means further includes means for grounding the input launchers in branches which have their power changed when the switching means in said branches is switched off.

13. A method of providing a controlled electric field within a resonant cavity having a plurality of input launchers, said method comprising the steps of:

splitting a driving signal into a plurality of controlled and non-controlled branches;

amplifying the signal in each branch separately with individual amplifiers;

applying the separate amplified signals to separate input launchers in the cavity;

sampling the electromagnetic field within the cavity; and controlling, in response to the sampled electromagnetic field, the amount of power which is transferred to the cavity from each controlled signal branch.

14. The method of claim 13 wherein there are more non-controlled signal branches than controlled signal branches.

15. The method of claim 13 wherein the power controlling is accomplished by changing the phase of the signal in any branch which is controlled.

16. The method of claim 13 wherein the power controlling is accomplished by pulse modulating the signal in any branch which is controlled.

17. The method of claim 16 including the step of grounding the associated input launcher when the pulse modulation effectively has the controlled branch turned off.

18. A cavity system having a controlled electric field for use in particle beam accelerators, said system comprising:

a resonant cavity having a pluarlity of input launchers;

means for splitting an RF signal into a plurality of signal branches;

means for amplifying the signal in each branch;

means for applying the amplified signal in each branch to separate input launchers in the cavity;

a signal means for sampling the electromagnetic field in the resonant cavity and providing a signal responsive to the sampled field; and means responsive to said sampled signal for changing the amount of power in at least one of said branches which contributes to the electric field contained within the resonant cavity, and including means for pulse modulating the signal in the branches which have their power changed, which pulse width modulating means includes RF switching means which switches on and off the signal which drives the amplifying means in said branches, and wherein switching means are connected to said input launchers for shorting said input launchers to ground in branches which have their power changed when said amplifying means is switched off by the pulse width modulating means.

* * * * *